US009225084B2

(12) United States Patent
Hodge

(10) Patent No.: US 9,225,084 B2
(45) Date of Patent: Dec. 29, 2015

(54) SUBSTRATE MOUNTED FLEXIBLE CIRCUIT BOARD CONNECTOR

(71) Applicant: Molex Incorporated, Lisle, IL (US)

(72) Inventor: Ronald C. Hodge, Chicago, IL (US)

(73) Assignee: Molex, LLC, Lisle, IL (US)

( * ) Notice: Subject to any disclaimer, the term of this patent is extended or adjusted under 35 U.S.C. 154(b) by 0 days.

(21) Appl. No.: 14/025,258

(22) Filed: Sep. 12, 2013

(65) Prior Publication Data

US 2014/0170867 A1 Jun. 19, 2014

Related U.S. Application Data

(60) Provisional application No. 61/700,115, filed on Sep. 12, 2012.

(30) Foreign Application Priority Data

Dec. 3, 2012 (CN) ..... 2012 2 0656328 U

(51) Int. Cl.
*H01R 12/00* (2006.01)
*H01R 12/62* (2011.01)
*H01R 13/24* (2006.01)

(52) U.S. Cl.
CPC ..... *H01R 12/62* (2013.01); *H01R 13/2442* (2013.01)

(58) Field of Classification Search
USPC ..... 439/67, 77, 492, 493
IPC ..... H01R 12/59,12/592, 12/61, 12/62, H01R 12/57, 13/2442
See application file for complete search history.

(56) References Cited

U.S. PATENT DOCUMENTS

| | | | | |
|---|---|---|---|---|
| 4,718,859 | A * | 1/1988 | Gardner | 439/329 |
| 5,458,506 | A * | 10/1995 | Yamaguchi et al. | 439/495 |
| 6,276,941 | B1 * | 8/2001 | Wu | 439/66 |
| 6,855,002 | B2 * | 2/2005 | Chiu | 439/495 |
| 7,182,629 | B2 | 2/2007 | Zhang et al. | |
| 7,575,468 | B2 * | 8/2009 | Chien et al. | 439/500 |
| 7,654,868 | B1 * | 2/2010 | Wang et al. | 439/630 |

FOREIGN PATENT DOCUMENTS

| | | | |
|---|---|---|---|
| CN | 200983417 | Y | 11/2007 |
| JP | 2000-173701 | A | 6/2000 |
| JP | 2004-086829 | A | 3/2004 |
| JP | 2005-141956 | A | 6/2005 |
| TW | M298808 | U | 10/2006 |

* cited by examiner

*Primary Examiner* — Vanessa Girardi
(74) *Attorney, Agent, or Firm* — Stephen L. Sheldon

(57) ABSTRACT

The present application provides a connection device and a connector. The connector comprises a housing mounted on a circuit substrate and a plurality of terminals. The housing has a recessed region and a plurality of channels. The recessed region, together with the circuit substrate, forms a mating groove for mating a flexible circuit board, and the mating groove extends forwardly to a radius. The plurality of terminals correspond to the plurality of channels and each of the terminal includes a resilient contact arm. The resilient contact arm extends toward a surface of the circuit substrate in the corresponding channel of the housing and extends into the recessed region to form a contact portion. The connection device comprises the circuit substrate and the connector.

10 Claims, 10 Drawing Sheets

SUBSTRATE MOUNTED FLEXIBLE CIRCUIT BOARD CONNECTOR

RELATED APPLICATIONS

This application claims priority to U.S. Provisional Application No. 61/700,115, filed Sep. 12, 2012, and to Chinese Application No. 201220656328.5, filed Dec. 3, 2012, both of which are incorporated herein by reference in their entirety.

FIELD OF THE PRESENT APPLICATION

The present application relates to a connector, more specifically to a connector suitable for use in low profile applications.

BACKGROUND OF THE PRESENT APPLICATION

A flexible circuit board may be connected to an electronic device by a connector. FIG. 1 illustrates a connector 1 for connecting a flexible circuit board, disclosed by China utility model patent application No. CN200620114384.0. The connector 1 comprises a housing 11 and a plurality of terminals 12. Each terminal 12 comprises a contact arm 121 and a supporting arm 122, wherein the flexible circuit board is sandwiched between the contact arm 121 and the supporting arm 122. The plurality of terminals 12 are spaced apart therebetween. The contact arms 121 are spaced by gaps, and the supporting arms 122 are also spaced by gaps, so that uneven surfaces are respectively formed at sides of the contact arms 121 and the supporting arms 122. The flexible circuit board which is sandwiched between the two uneven surfaces at the same time would be distorted, so that it is easy to cause contact points on the flexible circuit board misaligned, and thus result in problems that the contact points on the flexible circuit board can not contact or poorly contact the corresponding terminals.

Furthermore, the supporting arms 122 are inserted below the flexible circuit board, and make the flexible circuit board suspended above a circuit board on which the connector 1 is provided. To receive the supporting arm 122, it is necessary to increase a height of the connector 1; however, the connector 1 with higher height is not suitable for use in a thin electronic device.

Moreover, the terminal 12 has a soldering portion 123 and a fixed portion 124. The terminal 12 is fixed in the housing 11 by the fixed portion 124, and the soldering portion 123 is positioned behind the fixed portion 124 and extends rearwardly. This design for the soldering portion 123 would make a conductive path of the terminal 12 increased, which is beneficial to transmit high frequency signal.

FIG. 2 shows another existing connector 2, in which the connector 2 is disclosed by China utility model patent application No. CN200420078500.9 (corresponding to U.S. Pat. No. 7,182,629). The connector 2 comprises a housing 21, a plurality of terminals 22, and a pluggable member 23. While mating a flexible printed circuit board 24, firstly the flexible printed circuit board 24 is inserted into the housing 21, and then the pluggable member 23 is moved into the housing 21, so that pluggable member 23 presses the flexible printed circuit board 24 so as to make the flexible printed circuit board 24 electrically connect the terminals 22.

The use of the pluggable member 23 would make the inserted flexible printed circuit board 24 suspended above the circuit board 25 on which the connector 2 is provided. In order to receive the pluggable member 23, it is necessary for the housing 21 to have sufficient height. Therefore, this design tends to increase the height of the connector 2, which results in a connector that is not suitable for use in thin electronic devices.

Furthermore, the terminal 22 has a soldering portion 221 and a fixed portion 222. The terminal 22 is fixed in the housing 21 by the fixed portion 222, and the soldering portion 221 is positioned behind the fixed portion 222 and extends rearwardly. This design for the soldering portion 221 would make a conductive path of the terminal 22 increased, which is less beneficial to transmit high frequency signals.

SUMMARY OF THE PRESENT APPLICATION

A connector includes a housing and a plurality of terminals supported by the housing. The housing has a recessed region and a plurality of channels. The recessed region may be recessed from a bottom surface of the housing and extends forwardly to form an opening. The housing comprises a rear base portion, an upper wall body and two side shoulder portions. The rear base portion may be opposite to a radius of the housing that is aligned with the opening. The upper wall body may be opposite to the bottom surface of the housing. The two side shoulder portions may be positioned respectively at two opposite sides of the radius. The plurality of terminals correspond to the plurality of channels. Each terminal comprises a mounting leg, a tail portion and a resilient contact arm. The mounting leg can be secured by the housing. The tail portion extends out of the bottom surface of the housing. The resilient contact arm extends toward the recessed region in the corresponding channel of the housing and extends into the recessed region to form a contact portion.

A connection device of an embodiment of the present application comprises a circuit substrate and a connector. The connector includes a housing and a plurality of terminals supported by the housing. The housing is mounted on the circuit substrate. The housing has a recessed region and a plurality of channels, the recessed region is recessed from a bottom surface of the housing, and together with the circuit substrate, forms a mating groove for mating a flexible circuit board. The mating groove comprises a receptacle groove extending forwardly at a front end thereof. The receptacle groove has a radius. The housing comprises: a rear base portion opposite to the radius, an upper wall body opposite to the bottom surface of the housing, and two side shoulder portions respectively positioned at two opposite sides of the radius. The plurality of terminals correspond to the plurality of channels. Each terminal comprises a mounting leg, a tail portion and a resilient contact arm. The mounting leg may be held in the housing. The tail portion is soldered on the circuit substrate. The resilient contact arm extends toward a surface of the circuit substrate in the corresponding channel of the housing and extends into the mating groove to form a contact portion facing the surface. The flexible circuit board enters into the mating groove via the radius of the receptacle groove and the receptacle groove and is sandwiched between the circuit substrate and the contact portions of the plurality of terminals, the contact portion of the each terminal is electrically connected with a corresponding contact point of the flexible circuit board.

DESCRIPTION OF THE PREFERRED EMBODIMENTS

Hereafter, embodiments of the present application will be described in details in combination with accompany drawings.

In view of the foregoing problems, a technical problem to be resolved by the present application is to provide a connection device and a connector thereof, which can prevent contact points of a flexible circuit board from being misaligned and which can reduce the height of the connection device so as to make the connection device suitable for use in a thin electronic device.

As can be appreciated from a review of the described embodiments, because the circuit substrate has a flat surface it can help prevent contact points of a flexible circuit board from being misaligned. Because the recessed region, together with the circuit substrate, forms the mating groove for mating a flexible circuit board, a height of the connection device can be reduced so as to make the connection device suitable for use in a thin electronic device.

Figure 1:
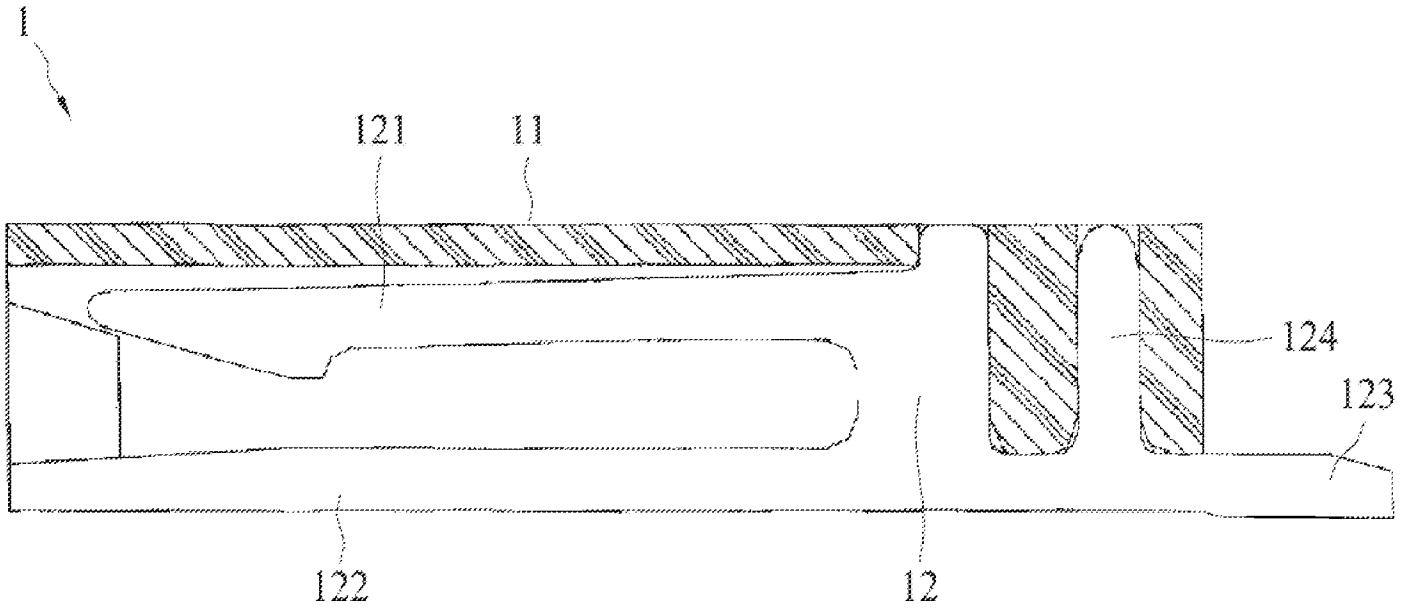
FIG. 1 (Prior Art)
FIG. 1 illustrates an existing connector disclosed by China utility model patent application No. 200620114384.0.
Figure 2:
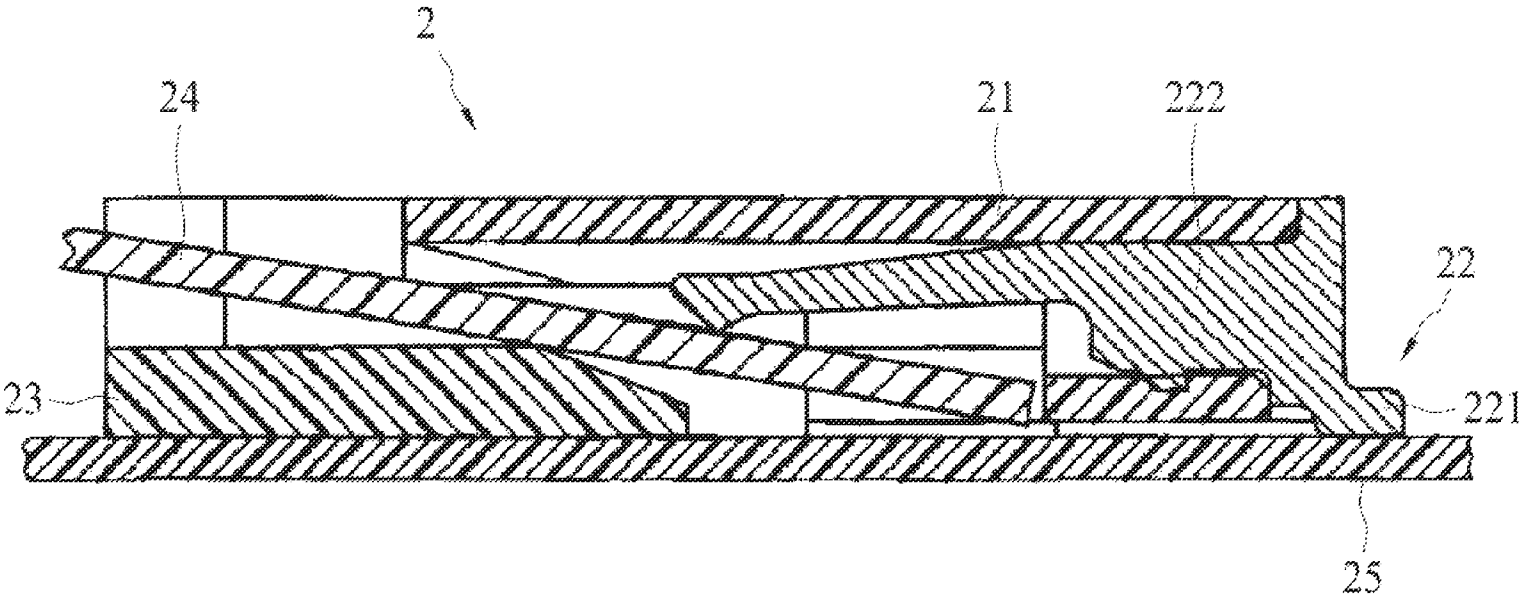
FIG. 2 (Prior Art)
FIG. 2 illustrates another existing connector disclosed by China utility model patent application No. 200420078500.9.
Figure 3:
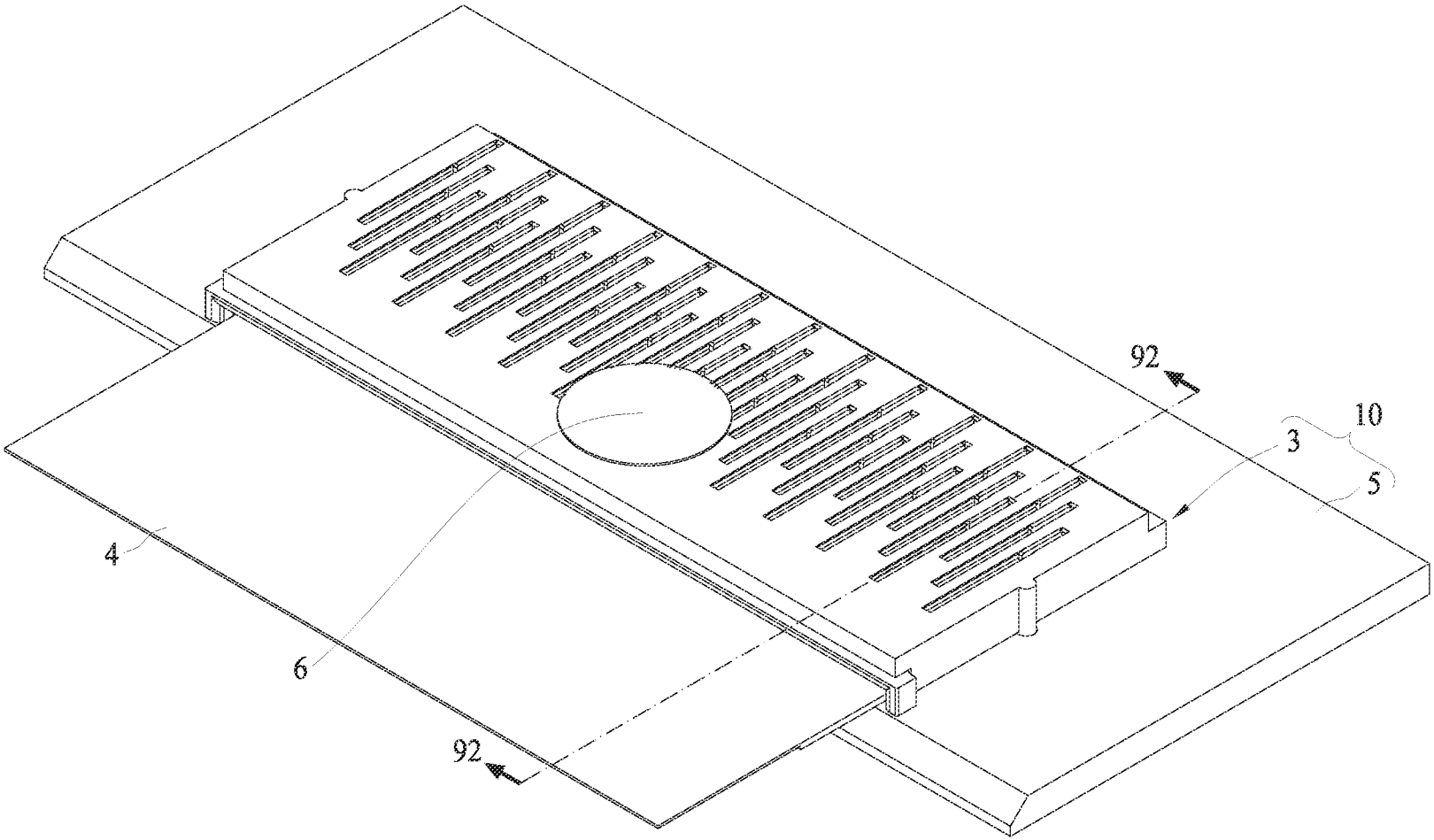
FIG. 3 is a perspective view of an embodiment of a connection device mated with a flexible circuit board.
Figure 4:
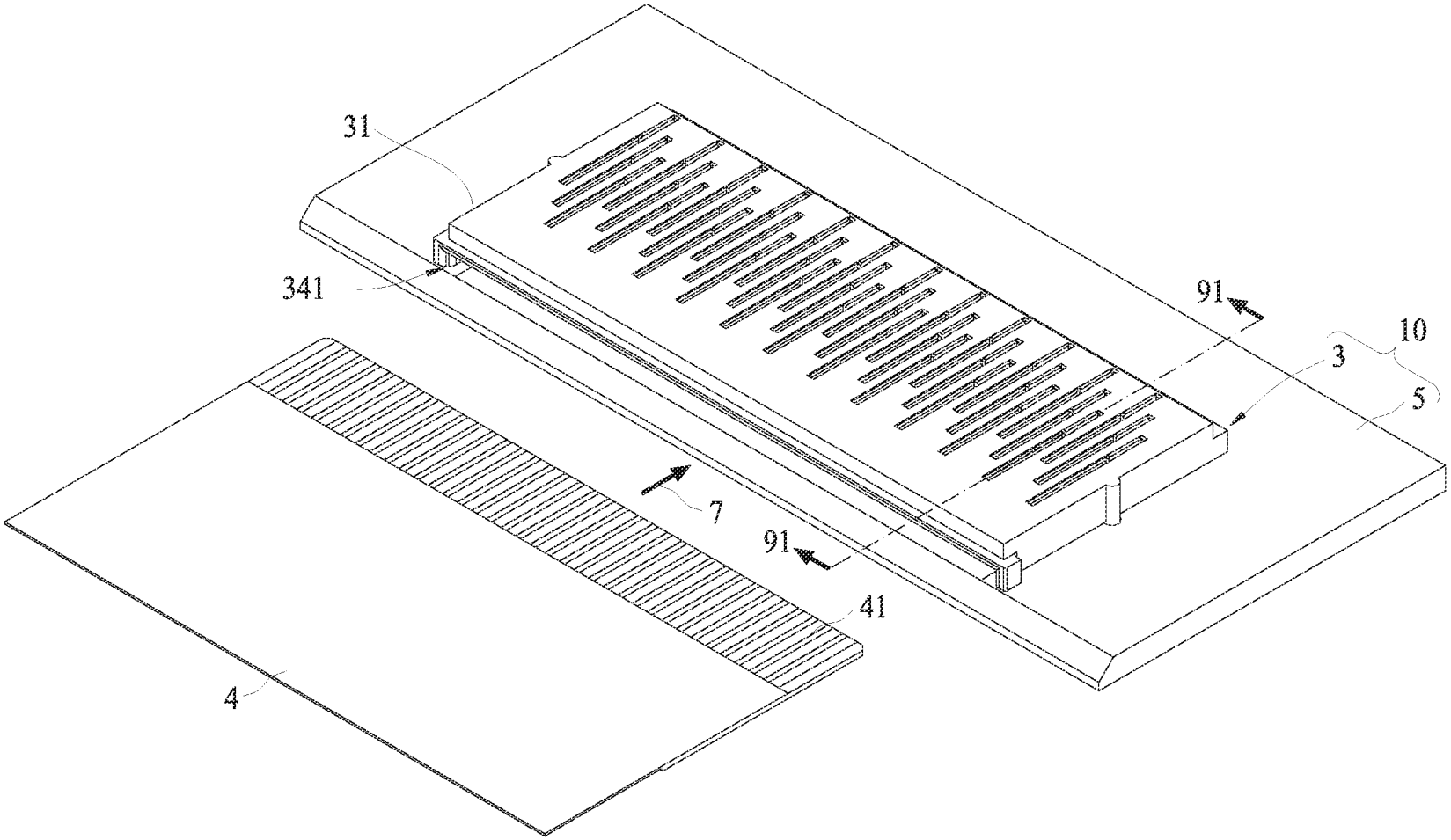
FIG. 4 is a perspective view of an embodiment of a flexible circuit board and a connection device in an unmated condition.
Figure 5:
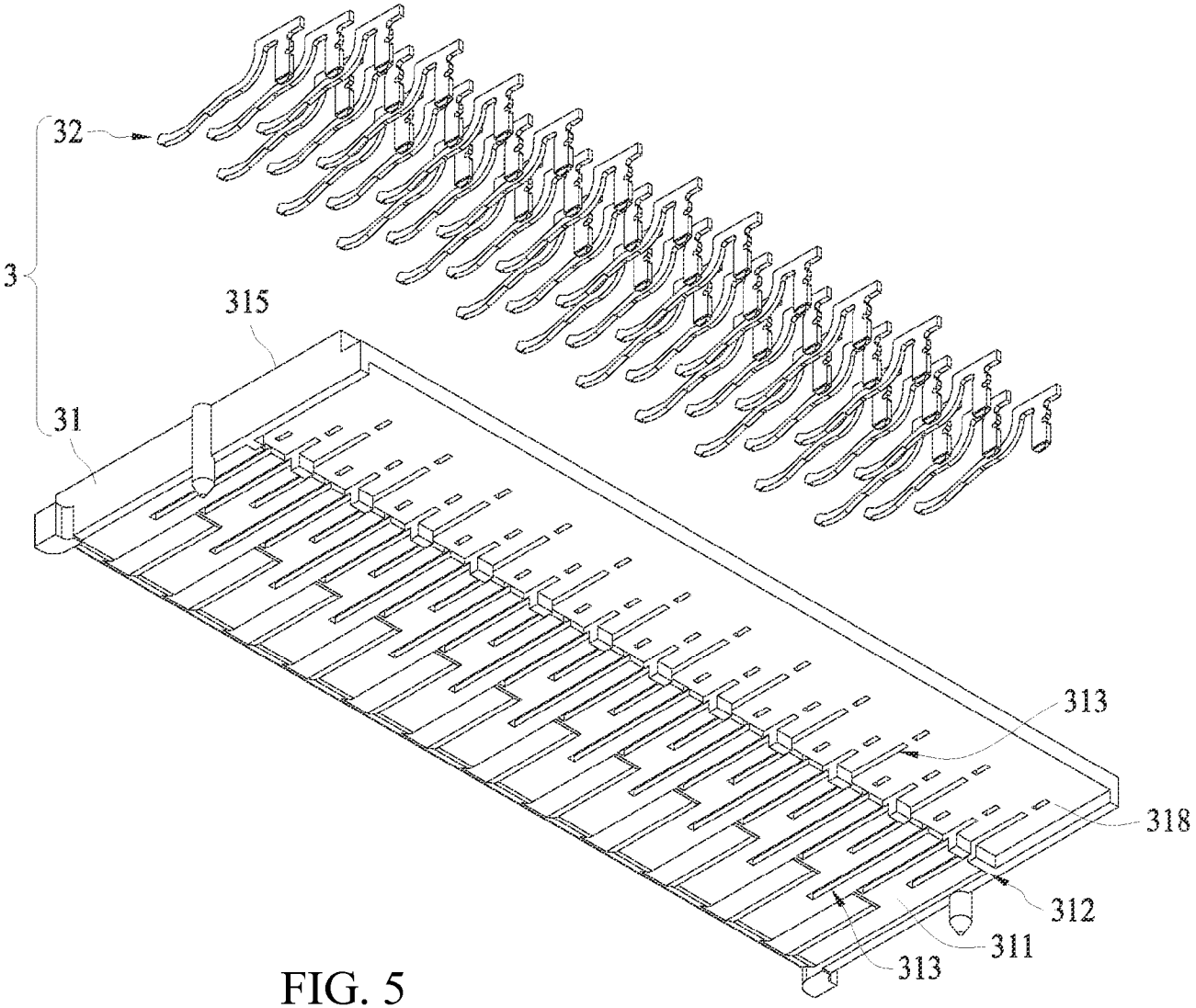
FIG. 5 is a partially exploded perspective view of a housing and a plurality of terminals of a connection device.
Figure 6:
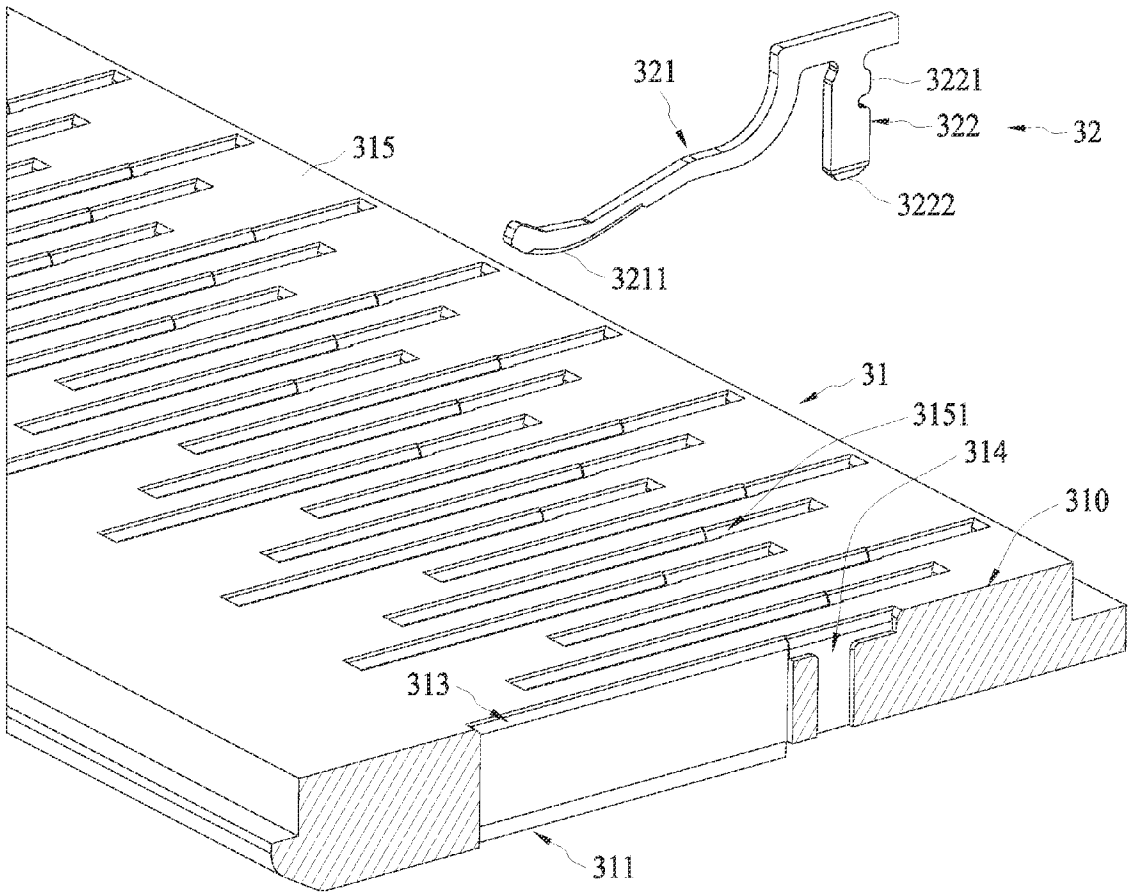
FIG. 6 is a simplified perspective view of an embodiment of a connector, illustrating channels and mounting holes of the housing.

FIG. 3 is a perspective view of an embodiment of the present application, which illustrates a connection device 10 mated with a flexible circuit board 4. FIG. 4 is a perspective view of an embodiment of the present application, which illustrates a flexible circuit board 4 and the connection device 10. FIG. 5 is a perspective view of an embodiment of the present application, which illustrates a housing 31 and a plurality of terminals 32 of the connector 3. FIG. 6 is a perspective view of an embodiment of the present application, which illustrates channels 313 and mounting holes 314 of the housing 31. Referring to FIGS. 3-6, an embodiment of the present application discloses a connection device 10 for mating a flexible circuit board 4, the connection device 10 comprises a circuit substrate 5 and a connector 3. The connector 3 may be mounted on the circuit substrate 5 and be electrically connected to the circuit substrate 5. The flexible circuit board 4 is inserted between the connector 3 and the circuit substrate 5 and contacts the circuit substrate 5, in this way, the connector 3 has a low height, so that the connector 3 may be suitable for use in a thin device. The circuit substrate 5 provides support for the connector 3 and also provides support for the flexible circuit board 4. Since the circuit substrate 5 may provide a flat surface, the flexible circuit board 4 on the circuit substrate 5 will not be distorted and thus contact points of the flexible circuit board 4 will not be misaligned, so that problems, such as poor contact and the like, can be avoided.

Referring to FIG. 3, the connector 3 may be provided with an insulative sheet 6 (which may have EMI absorption properties if desired). With the insulative sheet 6, a pick-place device may pick the connector 3 and mounts the connector 3 onto the circuit substrate 5.

Referring to FIG. 4, FIG. 5, FIG. 6 and FIG. 7, the connector 3 comprises a housing 31. The housing 31 may be mounted on the circuit substrate 5. The housing 31 may be formed with a recessed region 311. The recessed region 311 is recessed inwardly from a bottom surface 312 of the housing 31. The recessed region 311 of the housing 31 is exposed, after the connector 3 is mounted on the circuit substrate 5, the recessed region 311 of the housing 31, together with the circuit substrate 5, forms a mating groove 33 for mating the flexible circuit board 4.

Figure 7:
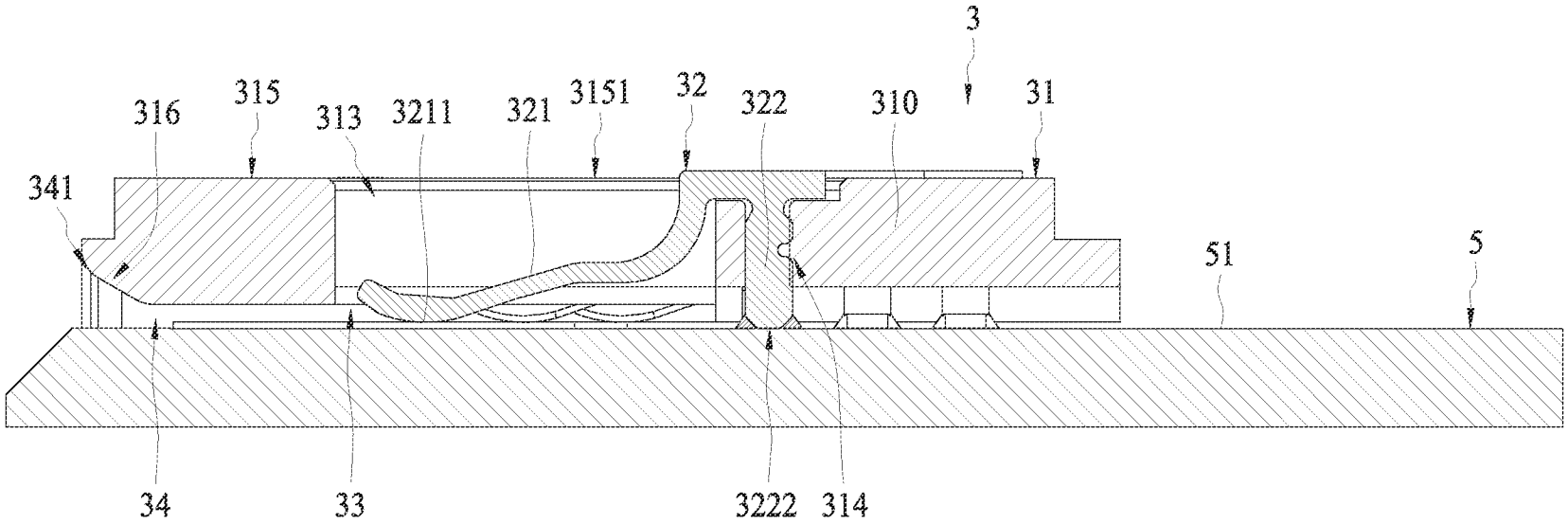
FIG. 7 is a sectional view taken along a line 91-91 of FIG. 4.
Figure 8:
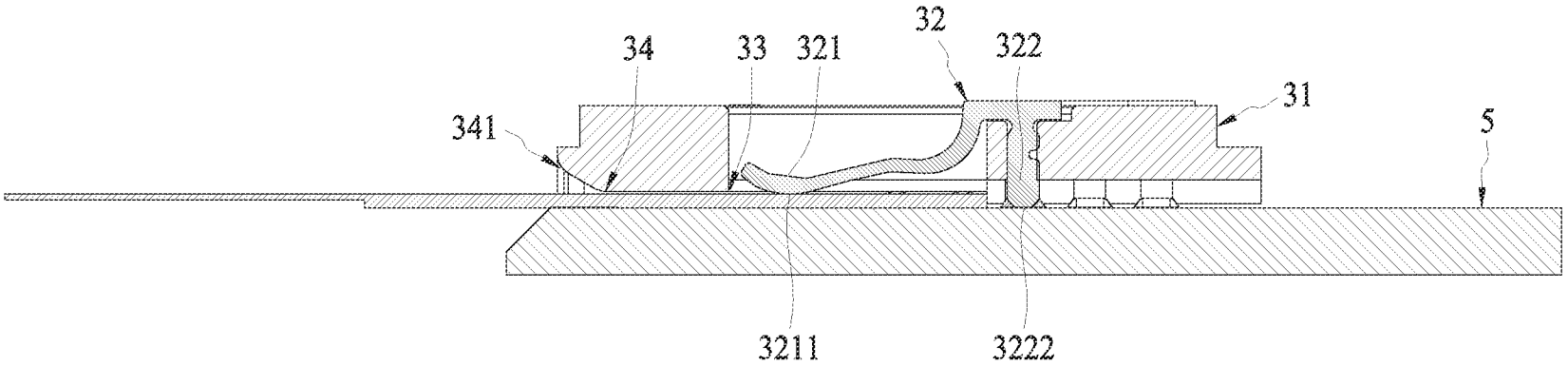
FIG. 8 is a sectional view taken along line 92-92 of FIG. 3.

Referring to FIG. 7, the mating groove 33 comprises a receptacle groove 34 extending forwardly at a front end thereof, the receptacle groove 34 has a radius 341. As shown in FIG. 4, FIG. 5 and FIG. 8, the connector 3 comprises a plurality of terminals 32. The plurality of terminals 32 may be arranged in a direction transverse to a mating direction 7 of the flexible circuit board 4. The plurality of terminals 32 may be fixed on the housing 31. The plurality of terminals 32 are used for electrically connecting the flexible circuit board 4 and the circuit substrate 5. The flexible circuit board 4 may be mated with the connector 3 via the radius 341. While mating, contact points 41 of the flexible circuit board 4 pass through the radius 341 and the receptacle groove 34, enter into the mating groove 33, and are sandwiched between the circuit substrate 5 and the plurality of terminals 32, and are electrically connected to the corresponding terminals 32 within the mating groove 33. As can be appreciated from FIG. 7, the mating groove includes three rows of contacts so as to provide good electrical performance but in other embodiments some other number of rows of contacts can be provided.

Figure 9:
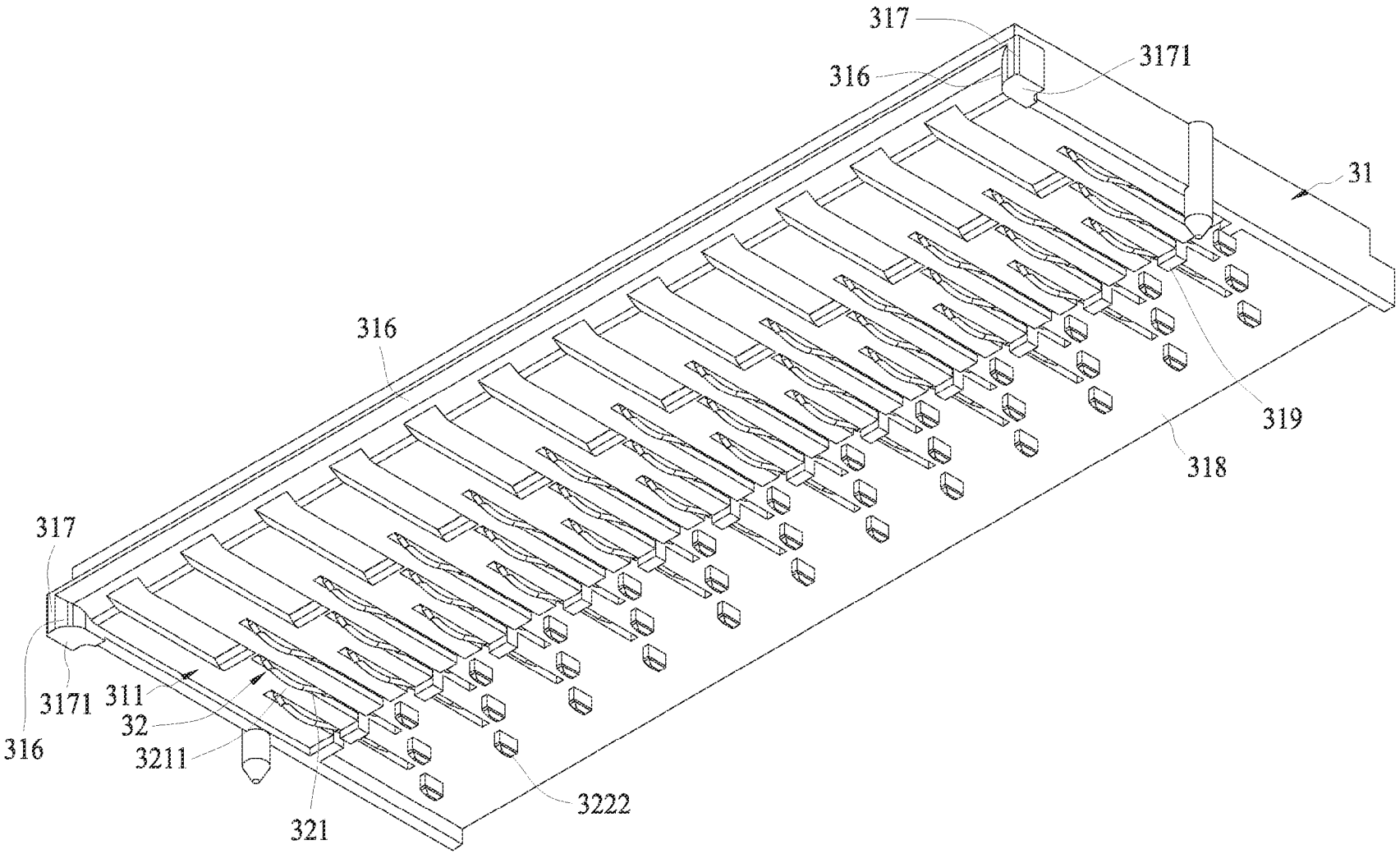
FIG. 9 is a perspective bottom view of an embodiment of a connector.

Referring to FIG. 6, FIG. 7 and FIG. 9, the housing 31 may be formed with a plurality of channels 313 communicated with the recessed region 311. The plurality of channels 313 correspond to the plurality of terminals 32. The plurality of channels 313 extend above the mating groove 33 and are communicated with the mating groove 33. The terminal 32 comprises a resilient contact arm 321, when the terminal 32 is mounted on the housing 31, the resilient contact arm 321 of the terminal 32 extend towards a surface 51 of the circuit substrate 5 within the corresponding channel 31 and extend into the mating groove 33. A part of the resilient contact arm 321 extending within the mating groove 33 comprises a contact portion 3211, wherein the contact portion 3211 faces the surface 51 of the circuit substrate 5, so as to sandwich the inserted flexible circuit board 4, together with the circuit substrate 5, and electrically connects the corresponding contact point 41 on the inserted flexible circuit board 4.

Referring to FIG. 6, the terminal 32 may comprises a mounting leg 322. The mounting leg 322 may be held in the housing 31, so that the terminal 32 may fixed in the housing 31. In an embodiment, referring to FIG. 6 and FIG. 7, the housing 31 comprises a rear base portion 310. The rear base portion 310 may be opposite to the radius 341. The rear base portion 310 may be formed with a plurality of mounting holes 314. The plurality of mounting holes 314 correspond to the plurality of terminals 32, wherein the mounting leg 322 of each terminal 32 is held in the corresponding mounting hole 314. In an embodiment, the mounting leg 322 of the terminal 32 is provided with at least a holding protrusion 3221, wherein the at least a holding protrusion 3221 is interferentially fitted with the corresponding mounting hole 314.

The terminal 32 may be electrically connected with the circuit substrate 5 below the connector 3, so as to make a conductive path of the terminal 32 short, therefore the terminal 32 is suitable for transmitting a high frequency signal. Referring to FIGS. 5-7, the mounting leg 322 of the terminal 32 may extend to the circuit substrate 5 toward a lower side of the housing 31, and is soldered on the circuit substrate 5. In an embodiment, the mounting leg 322 of the terminal 32 has a tail portion 3222, wherein the tail portion 3222 of the mounting leg 322 extends out of the bottom surface 312 of the housing 31, and may be soldered on an electrical connection point of the circuit substrate 5. In an embodiment, the resilient contact arm 321 is connected to the mounting leg 322, the mounting leg 322 extends straightly downwardly, and the tail portion 3222 is a distal end of the mounting leg 322 extending straightly downwardly, thereby making the terminal 32 have a short conductive path. In an embodiment, the rear base portion 310 of the housing 31 has a receiving space 318 recessed relative to the bottom surface 312, the tail portion 3222 of the mounting leg 322 extends into the receiving space 318, wherein provision of the receiving space 318 helps surface soldering of the tail portion 3222. In an embodiment, a stopper 319 having a separating function is positioned between the recessed region 311 and the receiving space 318, and the stopper 319 is used for limiting an inserted length of the flexible circuit board 4. In an embodiment, the housing 31 comprises a plurality of separated stoppers 319. In another embodiment, the housing 31 comprises a stopper 319 continuously extending between two sides of the housing 31.

Referring to FIGS. 5-7, the housing 31 comprises an upper wall body 315. The upper wall body 315 may be opposite to the bottom surface 312 of the housing 31. The plurality of channels 313 within which the resilient contact arms 321 of the terminals 32 extend are formed in the upper wall body 315. In an embodiment, the plurality of channels 313 are positioned in front of the plurality of mounting holes 314 for receiving the mounting leg 322 of the terminal 32.

Referring to FIGS. 7-10, the terminal 32 may be inserted downwardly into the housing 31 from an upper side of the upper wall body 315 of the housing 31 and may be fixed in the housing 31. In an embodiment, the upper wall body 315 of the housing 31 is formed with a plurality of openings 3151 in the upper surface thereof. The plurality of openings 3151 correspond to the plurality of channels 313 or the plurality of mounting holes 314, and each opening 3151 is communicated with the corresponding channel 313 and the corresponding mounting hole 314. The terminal 32 is inserted into the corresponding channel 313 and the corresponding mounting hole 314 from the corresponding opening 3151.

Referring to FIG. 7, the housing 31 comprises a guiding edge 316 which is positioned close to a periphery of the radius 341 and makes the front end of the receptacle groove 34 extend in a manner of expanding on the outside and contracting on the inside. Specifically, the guiding edge 316 is positioned at an upper edge close to the radius 341 and is formed at a front end of the upper wall body 315. The guiding edge 316 extends rearwardly (in the mating direction 7 of the flexible circuit board 4) in a manner of gradually closing to the circuit substrate 5. The guiding edge 316 may help the mating edge of the flexible circuit board 4 to guide into the receptacle groove 34 of the housing 31 when the flexible circuit board 4 is inserted into the connector 3, so that the flexible circuit board 4 may be smoothly inserted into the connector 3.

Referring to FIG. 9, the receptacle groove 34 comprises two side shoulder portions 317 respectively positioned at two opposite sides of the radius 341 and respectively formed by two sides of the housing 31 at two sides of the receptacle groove 34. The guiding edge 316 is formed by the way of making a part of inside surfaces of the two side shoulder portions 317 gradually close to each other, so as to guide the flexible circuit board 4 to insert into the connector 3. Bottom surfaces 3171 of the two side shoulder portions 317 slightly protrude out relative to the bottom surface 312 of the housing 31. For this reason, when the connector 3 is mounted on the circuit substrate 5 and the tail portions 3222 of the mounting legs 322 of the terminals 32 are soldered on the circuit substrate 5, the protruding bottom surfaces 3171 may make the housing 31 remain stable. In an embodiment, the two side shoulder portions 317 may protrude out toward outsides of the two sides of the housing 31 respectively so as to enlarge the bottom surface 3171.

Figure 10:
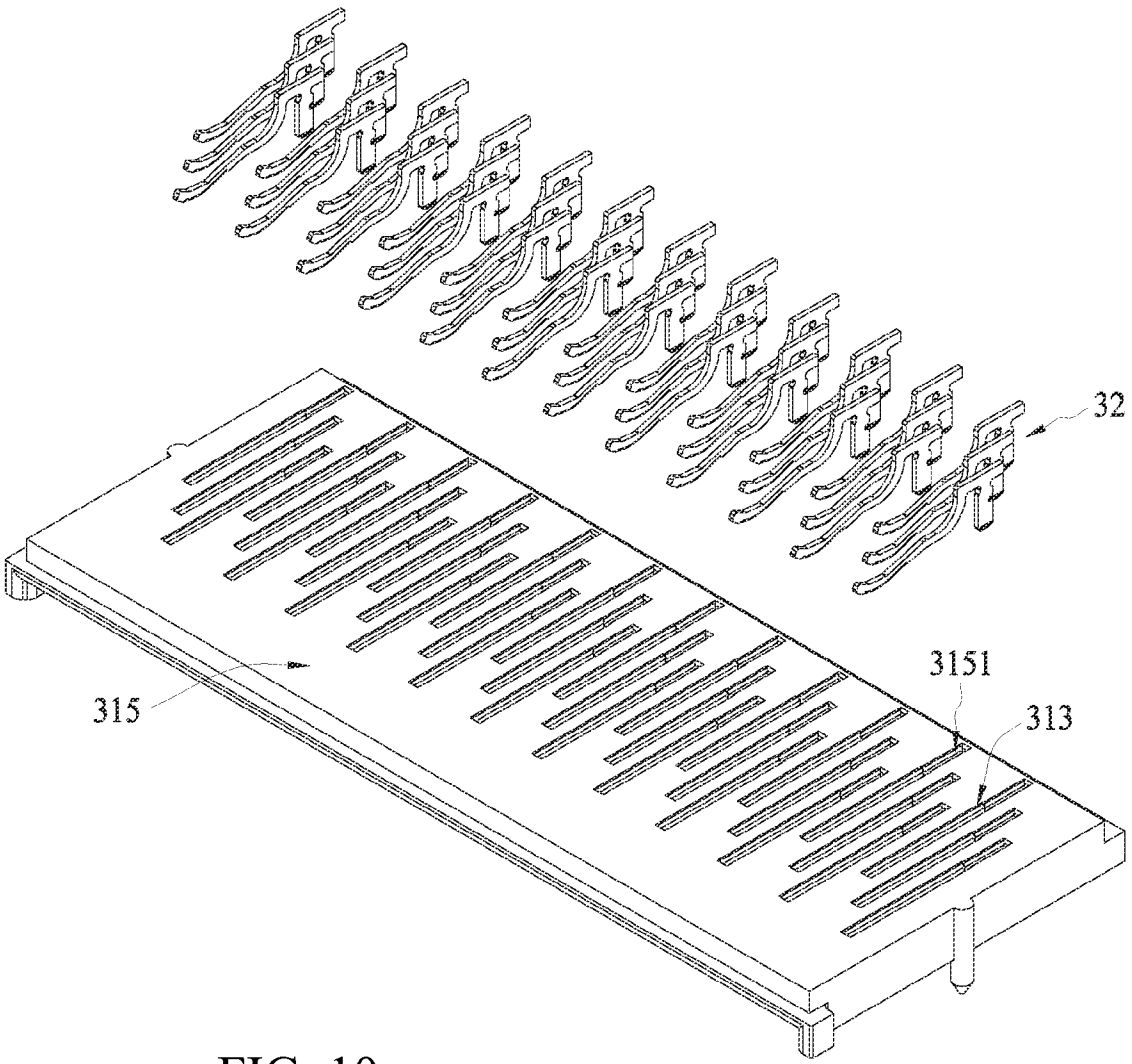
FIG. 10 is an exploded perspective view of an embodiment of a connector illustrating a housing and a plurality of terminals.

Referring to FIG. 10, the plurality of terminals 32 are arranged along an arrangement direction. The arrangement direction is transverse to the mating direction 7 of the flexible circuit board 4. The plurality of terminals 32 are not aligned along the arrangement direction. In an embodiment, the plurality of terminals 32 are arranged by a plurality of groups, each of which has three terminals 32, are repeatedly arranged along the arrangement direction, wherein three terminals 32 of each group are not aligned in the arrangement direction but are front-to-rear staggered in the mating direction 7 and have the contact portions 3211 staggered, in this way, when the flexible circuit board 4 just contacts the terminals 32 initially, the flexible circuit board 4 does not contact all of the contact portions 3211 at the same time, therefore, inserting force for the flexible circuit board 4 may be reduced. In an embodiment, the plurality of terminals 32 are positioned so that the contact portions 3211 of the adjacent terminals 32 are staggered. As can be appreciated from FIG. 7, the contact portions extend into the recess region and can be configured to rest on the supporting surface.

The depicted connector has a recessed region. The recessed region is positioned at a bottom portion of the connector and exposed, and may receive a flexible circuit board. The connector comprises a plurality of terminals. Contact portions of the plurality of terminals extend into the recessed region so as to allow electrical connection to a flexible circuit board. The connector may be mounted on a circuit substrate, and a surface of the circuit substrate forms a bottom surface of the recessed region so as to form a connection device. When the flexible circuit board is inserted into the connection device, the flexible circuit board lies against the circuit substrate. The circuit board has a flat surface, thereby preventing the contact points of the flexible circuit board from arising problems, such as misalignment and a poor contact. Furthermore, the surface of the circuit board is as the bottom surface of the recessed region, thereby reducing a height of the connection device, in this way, the connection device is suitable for a thin device. Moreover, the terminals of the connection device electrically connects the circuit substrate at the bottom portion of the connection device, therefore, the terminals have a short conductive path, so as to make the connection device suitable for transmitting high frequency signal.

Technical contents and technical features of the present application have been disclosed as above, but a person skilled in the art may still make various substitutions or modifications without departing from spirit of the present application according to the teachings and disclosed contents of the present application. Therefore, a protection scope of the present application should be not limited to the contents disclosed in the embodiments, but should include various substitutions or modifications which do not depart from the present application and are contained by the scope of the appended claims.

What is claimed is:

1. A connector comprising:

a housing having a recessed region and a plurality of channels communicated with the recessed region, the recessed region being recessed from a bottom surface of the housing and extending forwardly to a radius formed in the housing, the housing including a rear base portion opposite the radius, an upper wall body, the housing including two side shoulder portions respectively positioned at two opposite sides of the radius; and a plurality of terminals respectively positioned in the plurality of channels, each terminal including a mounting leg held in the housing, a tail portion extending out of the bottom surface of the housing, and a resilient contact arm extending toward the recessed region in the corresponding channel of the housing and extending into the recessed region to form a contact portion, wherein the resilient contact arm of the each terminal is connected to the mounting leg, the tail portion is a distal end of the mounting leg extending straightly downwardly and the terminal is inserted downwardly into the housing from an upper side of the upper wall body and wherein the plurality of terminals are positioned in a staggered manner along the recessed region so that the resilient contact arms of the adjacent terminals are staggered.

2. A connector comprising:

a housing having a recessed region and a plurality of channels communicated with the recessed region, the recessed region being recessed from a bottom surface of the housing and extending forwardly to a radius formed in the housing, the housing including a rear base portion opposite the radius, an upper wall body, the housing including two side shoulder portions respectively positioned at two opposite sides of the radius; and a plurality of terminals respectively positioned in the plurality of channels, each terminal including a mounting leg held in the housing, a tail portion extending out of the bottom surface of the housing, and a resilient contact arm extending toward the recessed region in the corresponding channel of the housing and extending into the recessed region to form a contact portion, wherein the contact portion is configured so as to contact a surface of a supporting substrate when the connector is installed.

3. A connector comprising:

a housing having a recessed region and a plurality of channels communicated with the recessed region, the recessed region being recessed from a bottom surface of the housing and extending forwardly to a radius formed in the housing, the housing including a rear base portion opposite the radius, an upper wall body, the housing including two side shoulder portions respectively positioned at two opposite sides of the radius; and a plurality of terminals respectively positioned in the plurality of channels, each terminal including a mounting leg held in the housing, a tail portion extending out of the bottom surface of the housing, and a resilient contact arm extending toward the recessed region in the corresponding channel of the housing and extending into the recessed region to form a contact portion, wherein the resilient contact arm of the each terminal is connected to the mounting leg, the tail portion is a distal end of the mounting leg extending straightly downwardly and the terminal is inserted downwardly into the housing from an upper side of the upper wall body and the rear base portion comprises a plurality of mounting holes respectively corresponding to the plurality of terminals, the mounting leg of the each terminal is held in the corresponding mounting hole, wherein the channel is positioned in the upper wall body and in front of the mounting hole and the plurality of terminals are positioned in a staggered manner along the recessed region so that the resilient contact arms of the adjacent terminals are staggered.

4. A connection device comprising:

a circuit substrate; and a connector comprising:

a housing mounted on the circuit substrate and having a recessed region and a plurality of channels communicated with the recessed region, the recessed region being recessed from a bottom surface of the housing, and together with the circuit substrate, forming a mating groove for mating a flexible circuit board, the mating groove comprising a receptacle groove extending forwardly at a front end thereof; the receptacle groove having a radius extending along the mating groove, the housing including a rear base portion opposite the radius, an upper wall body opposite to the bottom surface and two side shoulder portions respectively positioned at two opposite sides of the radius; and a plurality of terminals respectively corresponding to the plurality of channels, each terminal including a mounting leg held in the housing, a tail portion soldered on an electrical connection point of the circuit substrate and a resilient contact arm extending toward a surface of the circuit substrate in the corresponding channel of the housing and extending into the mating groove to form a contact portion facing the surface;

wherein, in operation, the flexible circuit board enters into the mating groove via the radius and the receptacle groove and is sandwiched between the circuit substrate and the contact portions of the plurality of terminals so that the contact portion of the terminals are electrically connected with a corresponding contact point of the flexible circuit board.

5. The connection device according to claim 4, wherein the resilient contact arm of the each terminal is connected to the mounting leg, the tail portion is a distal end of the mounting leg extending straightly downwardly.

6. The connection device according to claim 5, wherein the housing comprises a guiding edge which is positioned close to a periphery of the receptacle and makes a front end of the receptacle groove extend in a manner of expanding on the outside and contracting on the inside.

7. The connection device according to claim 5, wherein the terminal is inserted downwardly into the housing from an upper side of the upper wall body.

8. The connection device according to claim 7, wherein the rear base portion comprises a plurality of mounting holes respectively corresponding to the plurality of terminals, the mounting leg of the each terminal is held in the corresponding mounting hole.

9. The connection device according to claim 8, wherein the channel is positioned in the upper wall body and in front of the mounting hole.

10. The connection device according to claim 9, wherein the plurality of terminals are arranged along an arrangement direction, the plurality of terminals are not aligned along the arrangement direction, and the resilient contact arms of the adjacent terminals are staggered.

* * * * *